United States Patent [19]

Doering

[11] Patent Number: 4,687,056

[45] Date of Patent: Aug. 18, 1987

[54] PITLESS ADAPTOR

[76] Inventor: Garry L. Doering, Box 1469, Olds, Alberta, Canada, T0M 1P0

[21] Appl. No.: 652,684

[22] Filed: Sep. 20, 1984

[51] Int. Cl.[4] ..... E21B 33/04

[52] U.S. Cl. ..... 166/88

[58] Field of Search ..... 166/88, 89, 85; 417/44, 417/45

[56] References Cited

U.S. PATENT DOCUMENTS 3,050,124 8/1962 Ottenbacher ..... 166/88 X 3,154,148 10/1964 Peterson ..... 166/88

4,298,065 11/1981 Baski ..... 166/88

*Primary Examiner*—Stephen J. Novosad

*Assistant Examiner*—David J. Bagnell

*Attorney, Agent, or Firm*—William R. Hinds

[57] ABSTRACT

A pitless adapter normally includes a body containing a 90 degree passage for diverting water in a well casing from a vertical drop pipe to a horizontal service line. By continuing the vertical arm of passage through the top of the body and providing a removable plug in the top of the vertical arm, water can be bypassed through a top pipe to a frost free hydrant at the top end of the well casing.

7 Claims, 3 Drawing Figures

PITLESS ADAPTOR

BACKGROUND OF THE INVENTION

This invention relates to a pitless adapter.

Pitless adapters are used in wells for removing water laterally from the casing below the frost line. Conventional pitless adapters are disclosed by U.S. Pat. Nos. 2,689,611, issued to M. B. Martinson on Sept. 21 1954; 2,841,233, issued to H. W. Maas et al on July 1, 1958; 3,721,296, issued to H. A. Tubbs on Mar. 20, 1973; 3,805,891, issued to N. A. Reinhard et al on Apr. 23, 1974 and 4,298,065, issued to H. A. Baski on Nov. 3, 1981. With each of the adaptors described in these patents, water pumped up a vertical well pipe is discharged laterally through a horizontal pipe buried beneath the frost line (approximately 8 feet below ground level). The devices, which vary in complexity and efficacy, make no provision for the discharge of water from the vertical well pipe through a standard frost free hydrant at the top of the well casing above the pitless adapter.

In the past, using a conventional pitless adapter, the only manner in which water could be obtained outside of the building receiving water from the horizontal discharge pipe, was to install a frost free hydrant at some point along the discharge pipe. The hydrant is exposed to the elements of the soil when buried. Moreover, the hydrant is exposed through the drain hole intended to drain water from the hydrant to below the frost line, to all types of contamination from shallow surface water. The hydrant often becomes plugged or damaged by sand or silt washed into the hydrant through the drain hole.

Applicant's copending Canadian Patent Application Ser. No. 454,203-7, filed May 11, 1984 (corresponding to copending U.S. application Ser. No. 674,110 filed Nov. 21, 1984) proposes a solution to the problems discussed above. The object of the present invention is an alternative, even simpler solution to the problems.

BRIEF SUMMARY OF THE INVENTION

Accordingly, the present invention relates to a pitless adapter comprising body means for mounting in an opening in a well casing, passage means extending longitudinally through said body means for fluid connection with a top end of a vertical drop pipe; outlet means substantially perpendicular to said passage means for carrying water from said drop pipe to a horizontal service line; and removable plug means normally closing the top end of said passage means, whereby water can be diverted through the top end of said passage means and a top pipe to a hydrant or the like at the top of the casing.

BRIEF DESCRIPTION OF THE DRAWINGS

The invention will now be described in greater detail with reference to the accompanying drawings, which illustrate a preferred embodiment of the invention and wherein.

DESCRIPTION OF THE PREFERRED EMBODIMENTS

Figure 1:
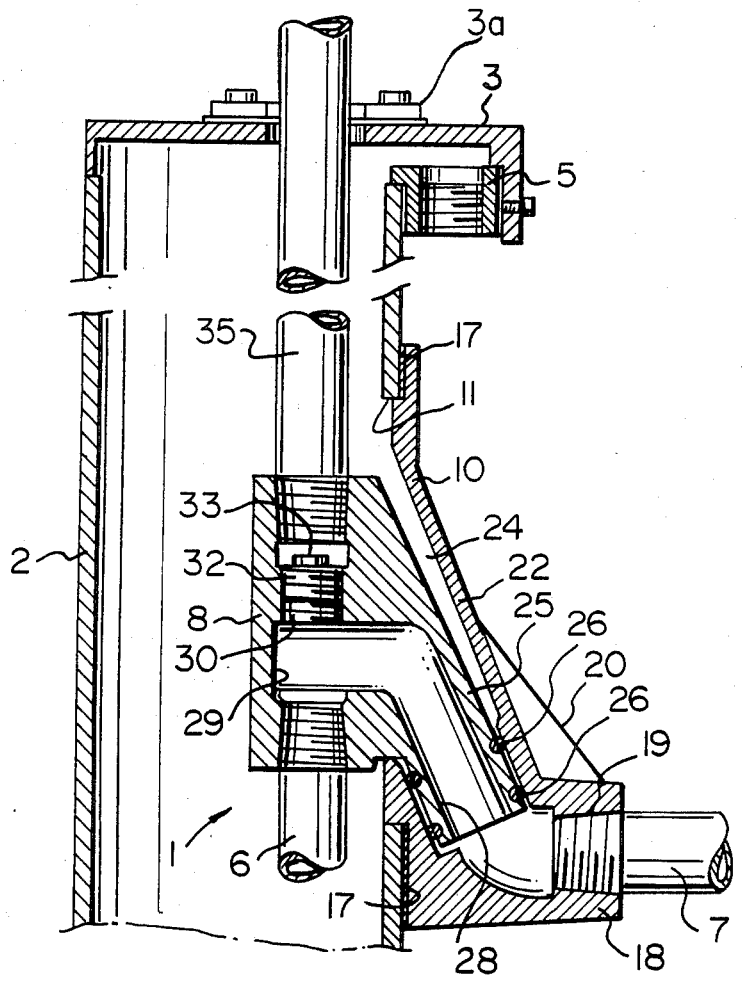
FIG. 1 is a longitudinal sectional view of a pitless adapter in accordance with the present invention.

Referring to the drawings, the pitless adapter of the present invention which is generally indicated at 1 is intended for use in a water well system of the type including a hollow casing 2 extending into a well. A cap 3 closes the top end of the casing 2. Cap 3 includes a separate flange 3(*a*) adapted to be positioned so as to centralize and secure the top pipe 35. Flange 3(*a*) can be provided as one piece or split into two parts facilitating ease of assembly and adjustment. An internally threaded fitting 5 is provided in the cap 3 for receiving an electrical conduit (not shown). The conduit extends into the well casing for providing power to the well pump (not shown). Water is pumped to a location near the surface through a drop pipe 6 in the casing 2. The pitless adapter 1 is used to feed water from the drop pipe 6 to a horizontal service line 7, which is buried in the ground below the frost line.

In the conventional pitless adapter of the type described in the patents mentioned herein, the top end of the adapter is connected to the cap 3 by a pipe or rod for stablizing the adapter in the well casing 2 and is terminated below the well cap. There is no means for withdrawing water through the top of the casing 2.

Figure 2:
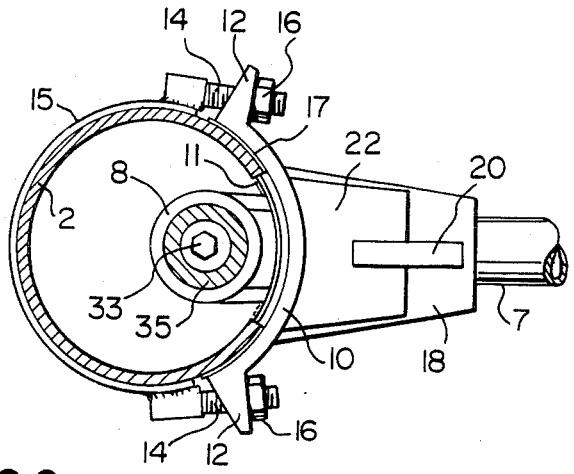
FIG. 2 is a front elevation view of the adapter of FIG. 1.
Figure 3:
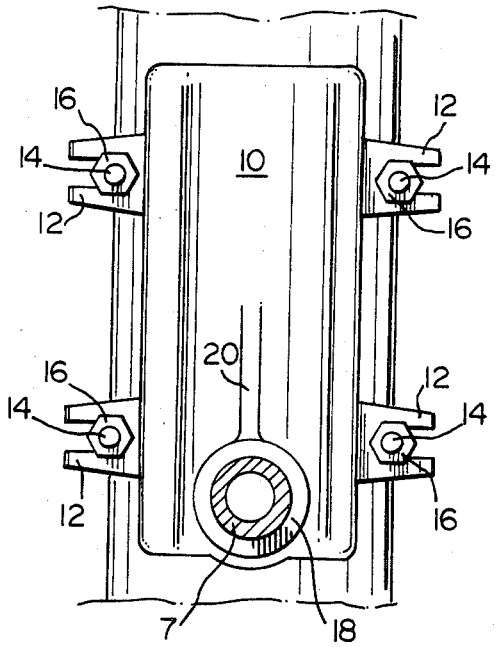
FIG. 3 is a cross section taken generally along line II—II OF FIG. 1.

The pitless adapter 1 of the present invention includes a body 8, which is mounted in the casing 2 by means of an elongated arcuate cover plate 10. The cover plate 10 is designed to cover an elongated opening 11 in the casing 2. The body 8 and the cover plate 10 are provided as a single unit, which is easily installed in the opening 11 in the casing 2. For such purpose, outwardly extending slotted lugs 12 (FIGS. 2 and 3) are provided on the sides of the plate 10 for receiving bolts 14 on the ends of a pair of bands 15 (one shown). Nuts 16 provided on the ends of the bolts 14 for pulling the cover plate 10 against the casing 2. A gasket 17 provides a fluid tight seal between the casing 2 and the cover plate 10.

A horizontal outlet 18 of the cover plate 10 contains an internally threaded passage 19 for connecting the cover plate 10 to the service line 7. A strengthening gusset 20 extends between the outlet 18 and the inclined outer surface 22 of the plate 10. An upwardly inclined passage 24 at the inner end of the passage 19 receives an outwardly and downwardly inclined arm 25 of the body 8. O-rings 26 form a fluid tight seal between the plate 10 and the arm 25. The arm 25 contains a passage 28, which extends horizontally outwardly and then downwardly from a continuous vertical passage 29 in the body 8.

The bottom end of the passage 29 receives the top end of the drop pipe 6. An internally threaded, reduced diameter neck 30 is provided in the passage 29 above the junction with the passage 28. A threaded isolation plug 32 normally sits in the neck 30. A hexagonal head 33 is provided on the top end of the plug 32, so that the plug can be gripped by a socket wrench (not shown). The top end of the passage 29 is also threaded for receiving a top pipe 35, which extends upwardly through the cap 3 to a yard hydrant (not shown).

With the adapter 1 installed and the plug 32 in position, water normally passes from the drop pipe 6 through the passages 29 and 28 into the horizontal service line 7. When water is required at the top of the casing 2, the plug 32 is removed, which permits the flow of water directly to the surface via the top pipe 35.

What I claim is:

1. In a well casing having an opening in a wall of the casing, a pitless adaptor comprising body means, means mounting the body means in the casing opening, passage means extending longitudinally through said body means, the lower end of said passage means being connected in fluid communication with the upper end of a vertical drop pipe, outlet means substantially perpendicular to said passage means for carrying water from said drop pipe to a horizontal service line, the upper end of said passage means being connected with the lower end of a top pipe so as to be capable of fluid communication therewith, the top pipe extending within and to the upper end of the casing for connection to a hydrant or the like at the top of the casing, and removable plug means normally closing the upper end of said passage means, whereby water can be diverted through the upper end of said passage means and the top pipe to a hydrant or the like at the top of the casing by removal of said plug.

2. A pitless adapter according to claim 1, wherein said passage means includes a reduced diameter portion for receiving said plug means, and said plug means is smaller in diameter than the top end of said passage means and said top pipe, whereby said plug means is readily accessible through said top pipe.

3. Apparatus as claimed in claim 1 wherein said mounting means comprises a cover plate mounted over the casing opening, and clamping means securing the cover plate to the casing.

4. Apparatus as claimed in claim 3 wherein said cover plate includes means for connection with a horizontal service line, and includes a passage sealingly receiving a hollow arm carried by said body means, the hollow arm and passage comprising said outlet means between said passage means and the connection for a horizontal service line.

5. Apparatus as claimed in claim 4 wherein the hollow arm and the passage in the cover plate are inclined downwardly.

6. Apparatus as claimed in claim 1 wherein a cap closes the top end of the casing and includes an opening through which said top pipe extends, and further including a separate flange carried by said cap and positionable to position and secure said top pipe.

7. Apparatus as claimed in claim 6 wherein said flange is a split flange comprising two parts to facilitate assembly and adjustment of the top pipe.

* * * * *